US007589321B2

(12) United States Patent
Hashimoto et al.

(10) Patent No.: US 7,589,321 B2
(45) Date of Patent: Sep. 15, 2009

(54) REACTION CELL AND MASS SPECTROMETER

(75) Inventors: Yuichiro Hashimoto, Tachikawa (JP); Hideki Hasegawa, Tachikawa (JP); Takashi Baba, Kawagoe (JP); Izumi Waki, Tokyo (JP)

(73) Assignee: Hitachi High-Technologies Corporation, Tokyo (JP)

( * ) Notice: Subject to any disclaimer, the term of this patent is extended or adjusted under 35 U.S.C. 154(b) by 271 days.

(21) Appl. No.: 11/671,562

(22) Filed: Feb. 6, 2007

(65) Prior Publication Data

US 2008/0073508 A1 Mar. 27, 2008

(30) Foreign Application Priority Data

Feb. 6, 2006 (JP) ..... 2006-0727860

(51) Int. Cl.
*H01J 49/42* (2006.01)

(52) U.S. Cl. ..... 250/292; 250/281

(58) Field of Classification Search ..... 250/292, 250/281

See application file for complete search history.

(56) References Cited

U.S. PATENT DOCUMENTS

| | | | | |
|---|---|---|---|---|
| 5,783,824 | A | 7/1998 | Baba et al. | |
| 7,071,464 | B2 * | 7/2006 | Reinhold | 250/282 |
| 2008/0191130 | A1 * | 8/2008 | Bateman et al. | 250/283 |

FOREIGN PATENT DOCUMENTS

JP 2005-235412 9/2005

OTHER PUBLICATIONS

Anal. Chem. 1999, 71 4431-4436.
Anal. Chem. 2003, 75 (13) 3256-3262.
53rd ASMS Conference and Allied Topics, WP08-135, 2005, San Antonio, Texas.

* cited by examiner

*Primary Examiner*—Kiet T Nguyen
(74) *Attorney, Agent, or Firm*—Antonelli, Terry, Stout & Kraus, LLP.

(57) ABSTRACT

An ion trap in which highly accurate isolation, ECD, and CID can be efficiently performed. A reaction cell and a mass spectrometer of the present invention include an ion-trap which has a plurality of rod electrodes and creates a multipole field, a means for generating a magnetic field in the axial direction of the ion-trap, a means for creating a DC harmonic potential in the axial direction of the ion-trap, and an electron source for introducing electrons into the central axis of the ion-trap. The identification ability is greatly improved compared with the prior art.

16 Claims, 5 Drawing Sheets

REACTION CELL AND MASS SPECTROMETER

CLAIM OF PRIORITY

The present application claims priority from Japanese application JP 2006-027860 filed on Feb. 6, 2006, the content of which is hereby incorporated by reference into this application.

FIELD OF THE INVENTION

The present invention relates to a reaction cell and a mass spectrometer.

BACKGROUND OF THE INVENTION

Electron Capture Dissociation (ECD) is important in proteome analysis, specifically, peptide analysis after translational modification. Hereinafter, which system configuration has been used conventionally for ECD and for ECD with other reactions will be described.

Anal. Chem. 1999, 71, 4431-4436 describes that EDC occurs by injecting low energy ions with 1 eV or less in a strong magnetic field of several teslas or more. Since ions and electrons can be efficiently trapped in a strong magnetic field of 1 Tesla or more by moderately controlling a surrounding DC electric field, it is possible to progress ECD reaction.

In Anal. Chem. 2003, 75(13), 3256-3262 as well as in Anal. Chem. 1999, 71, 4431-4436, ECD is performed by injecting low energy ions of 1 eV or less into a strong magnetic field of 1 Tesla or more. Then, by selecting only ions other than a specific ion, multi-photon dissociation is performed by irradiating a laser beam onto the selected ions having a specific m/Z. Moreover, it is not shown in this embodiment, and it is principally possible to perform collision induced dissociation by introducing gas pulses.

In JP-A No. 235412/2005, a weak magnetic field of a few hundred millitesla or less is superimposed in the axial direction in the RF linear-trap. Ions are trapped in the radial direction by an electric field potential created by RF and in the axial direction by a DC electric field potential created by the end electrodes. Moreover, it is described that the energy deposition onto the electrons from the RF electric field is suppressed by the magnetic field applied to the linear-trap axis.

Proceedings of 53rd ASMS Conference and Allied Topics, WP08-135, 2005, San Antonio, Tex. discloses a study of the principles for performing ECD, isolation, and a CID technique in the RF linear-trap described in JP-A No. 235412/2005. Isolation and CID are predicated on the resonance conditions and boundary conditions in an RF electric field in the radial direction as well as in a typical linear-trap.

U.S. Pat. No. 5,783,824 discloses a method where a DC harmonic potential is created in the axial direction in the RF linear trap and ions having a specific m/Z are resonance-ejected, in order, outside the trap.

SUMMARY OF THE INVENTION

In order to trap ions efficiently, a magnetic field of 1 Tesla or more (preferably, 2 Tesla or more) is required in Anal. Chem. 1999, 71, 4431-4436 and Anal. Chem. 2003, 75(13), 3256-3262. Therefore, since a superconducting magnet has to be used, there is a problem that upsizing the equipment and an increase in the maintenance expense cannot be avoided.

In JP-A No. 235412/2005, there is no description of a method for isolation before and after ECD reaction and a method for ion collision induced dissociation.

In Proceedings of 53rd ASMS Conference and Allied Topics, WP08-135, 2005, San Antonio, Tex., the isolation and CID technique uses resonance and boundary conditions in the radial direction, and, since a stable trapping condition is split by applying a magnetic field in the axial direction, it is described that precise isolation and CID cannot be performed.

In U.S. Pat. No. 5,783,824, there is no description of an isolation technique and ion collision induced dissociation (CID) in the ion-trap. It is an objective of the present invention that isolation, ECD, and CID are sequentially carried out with accuracy by using an RF linear-trap.

A reaction cell and a mass spectrometer include an ion-trap which has a plurality of rod electrodes and creates a multipole field, a means for generating a magnetic field in the axial direction of the ion-trap, a means for creating a DC harmonic potential in the axial direction of the ion-trap, and an electron source for introducing electrons to the central axis of the ion-trap.

According to the configuration of the present invention, a highly accurate isolation, ECD, and CID can be efficiently performed.

DETAILED DESCRIPTION OF THE PREFERRED EMBODIMENTS

First Embodiment

Figure 1:
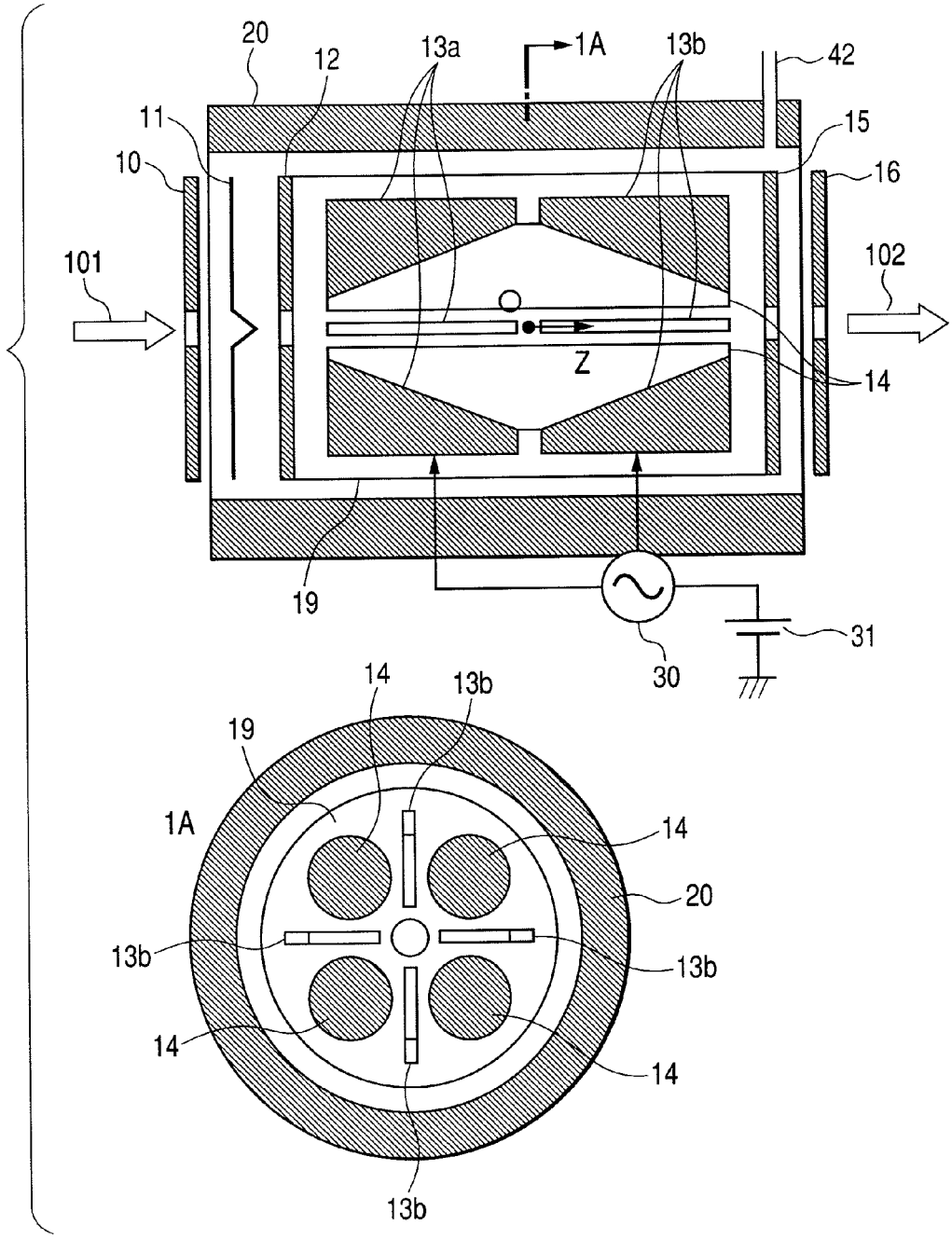
FIG. 1 is the first embodiment using a method of the present invention.
Figure 2:
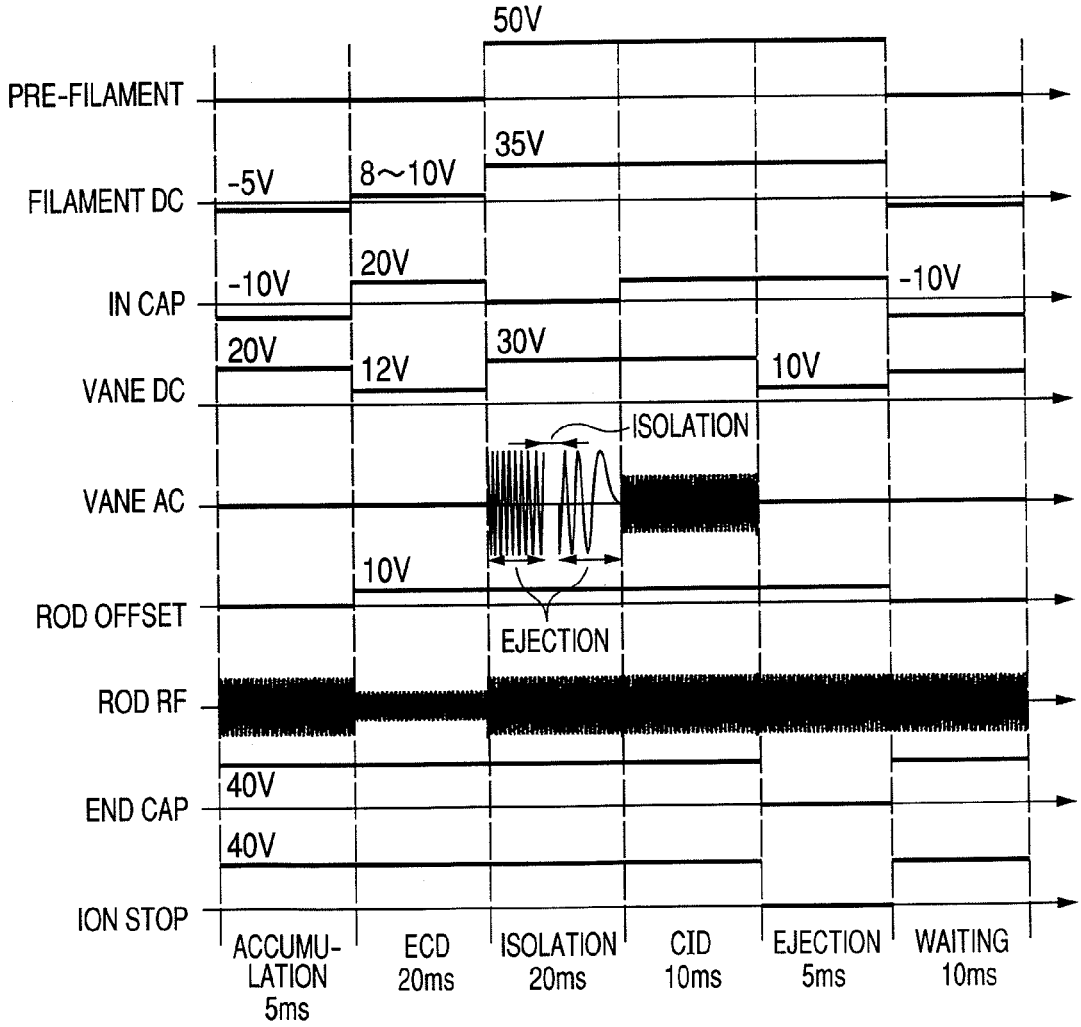
FIG. 2 shows a measurement sequence of the first embodiment using a method of the present invention.

FIG. 1 contain block diagrams (cross-sectional views) illustrating an ion-trap (hereinafter, an ECD/CID trap) utilizing the present method where an ECD/CID reaction is enabled. FIG. 2 is a typical measurement sequence of an ECD/CID trap. Ions generated by various ion sources pass through the ion guide, the ion-trap, and the Q-mass filter and they are introduced into the ECD/CID trap along the direction of arrow 101. Ions passing through a pre-filament electrode 10, a filament 11, and an in-cap electrode 12 are introduced into the area surrounded by an in-cap electrode 12, rod electrode 14, an end-cap electrode 15, and electrode a fore-and-aft vane lens 13. A magnetic field from about 10 millitesla to 0.3 tesla is applied by a magnet 20 to the filament and to the area where ions are stored. An electro-magnet may be utilized as the magnet 20 in addition to a permanent magnet such as ferrite and neodymium. A material like tungsten is used for the filament 11. When a thick filament is used, since a loss is generated during the passage of ions, it is preferable to use a wire having a diameter from about 0.03 mm to 0.3 mm. As an electron source, any one which creates electrons may be used in addition to a filament. An anti-phase trap RF voltage (frequency 200-2 MHz (typically 0.5 MHz) with amplitude 50 V to 500 V) is applied alternately to each rod electrode 14. Moreover, an inert gas such as helium, etc. is introduced into the inside of the trap by way of the gas inlet tube 42. An appropriate pressure is from 0.03 to 3 Pa in the case of helium and from about 0.01 to 1 Pa in the case of argon and nitrogen in order to be compatible with the efficiency of the fragment ion and the selectivity of isolation. After introducing ions, electrons are introduced for ECD. The energy of electrons is controlled to be 0 to several electron-volts or less by the DC potential of the filament 11, the offset potential of the rod electrodes 14, and the potential difference of the vane lens 13. Low energy electrons create fragment ions by reacting with trapped ions. Moreover, it is also possible to irradiate high energy ions of several electron-volts or more by controlling the energy of the electrons. In this case, a reaction such as HotECD etc. progresses with respect to cations and a reaction such as Electron detachment Dissociation (EDD) etc. progresses with respect to anions, resulting in fragment ions being created.

A DC voltage 31 from about 5 to 200 V is applied to the vane lens 13 relative to the offset potential of the rod electrodes 14 corresponding to each measurement sequence described later. As a result, it is possible to create a DC harmonic potential on the center axis (on the Z axis) where the circle in the figure is assumed to be a minimum point. Herein, when the magnitude of the harmonic potential formed on this axis is assumed to be $D_0$ and the distance between the minimum point of the harmonic potential and the edge to be a, the potential in the axial direction at the distance Z from the minimum point of the harmonic potential is approximated by expression 1.

$$D(z) \approx D_0\left(\frac{z}{a}\right)^2 \qquad \text{(Expression 1)}$$

Moreover, an AC voltage generated by the supplemental AC power source is applied between the fore-and-aft vane lens 13*a* and 13*b*. A voltage is applied where the typical voltage magnitude is from 0.5 to 20 V and the frequency is a single frequency from 1 to 100 kHz or a voltage where these are superimposed. The selectivity of these frequencies will be explained as follows. An equation of motion in the z direction is written as (expression 2).

$$m\frac{d^2 z}{dt^2} = -2eD_0\frac{z}{a^2} \qquad \text{(Expression 2)}$$

Herein, m is the molecular weight of the ion and e is the electron quantum. According to what was mentioned above, the resonance frequency f in the z direction is written as (expression 3).

$$f = \frac{1}{2\pi}\sqrt{\frac{2eD}{ma^2}} \qquad \text{(Expression 3)}$$

For instance, f is written as (expression 4) when D=40 V and a=25 mm.

$$f = 5.6\times10^5\times\frac{1}{\sqrt{M}}\ \text{Hz} \qquad \text{(Expression 4)}$$

M is the mass charge ratio. It decreases inversely proportional to the square root of the mass charge ratio. By applying a supplemental AC voltage 30 between the fore-and-aft vane lens (13*a* and 13*b*), it is possible to oscillate ions having a mass charge ratio which is resonated in the axial direction. Moreover, the ions are accelerated in the z direction by the resonant oscillation.

When the velocity vector of the ion is assumed to be $\vec{v}$ the ion receives the force $\vec{F}$ in a magnetic field. $\vec{B}$ $$\vec{F} = e\vec{v}\times\vec{B} \approx e\begin{pmatrix}0\\0\\v_z\end{pmatrix}\times\begin{pmatrix}0\\0\\B_z\end{pmatrix} = \vec{0} \qquad \text{(Expression 5)}$$

From the expression 5, it is understood that the resonance frequency is not influenced by the magnetic field when the direction of the oscillation is same with the direction of the magnetic field. Therefore, m/Z and the frequency can be uniquely associated in a specific potential D by the (expression 3) without the influence of the magnetic field.

As a method for isolating a specific ion, there are methods where ions are left by scanning the frequency of the supplemental AC voltage shown in FIG. 2 and lowering the amplitude only at the timing of the specific frequency, and where a superimposed wave, in which a specific frequency corresponding to the m/Z of the ion remaining in the trap is subtracted, is synthesized and applied between the fore-and-aft vane lens as a supplemental AC voltage, etc. In any method, since the ion oscillates in the axial direction, isolation can be carried out without receiving the influence of the magnetic field as clearly shown in the (expression 5). In the method in which the frequency of the supplemental AC voltage is scanned, it is preferable that the potential D be controlled to be 30 V or less in order to avoid the isolation in the trap.

Next, collision induced dissociation (CID) is performed. At this time, it is preferable that the potential D be controlled to be 20 V or more in order to promote efficient dissociation. A supplemental AC voltage corresponding to the target ion for CID is applied to the fore-and-aft vane lens. Even in CID, as shown in the (expression 5), the supplemental AC frequency and m/Z have a unique relationship without the influence of the magnetic field. As a result, the collision induced dissociation of ion and gas in the trap occurs, resulting in fragment ions being created. Although only the cases of ECD, isolation, and CID are described above, reactions other than these can be performed by combining a sequence of these in various ways. Although the number of the rod electrodes is four in this embodiment, it may also be 6, 8, 10, and 12. There is an advantage that the injection efficiency of electrons increases because of the reduction of the RF electric field gradient in the vicinity of the trap axis with an increase in the number of rods. In the case when the number of rod electrodes is 6 or more, mass selectivity and CID become quite impossible when a method of Proceedings of 53rd ASMS Conference and Allied Topics, WP08-135, 2005, San Antonio, Tex. is used, and isolation and CID become possible only by using this method.

Afterward, the ions are ejected in the direction of arrow 102 by passing through the end-cap electrode 15 and the ion stop electrode 16. The ejected ions are detected at the mass analysis section such as the ion trap, TOF, and FTICRMS, etc.

Second Embodiment

Figure 3:
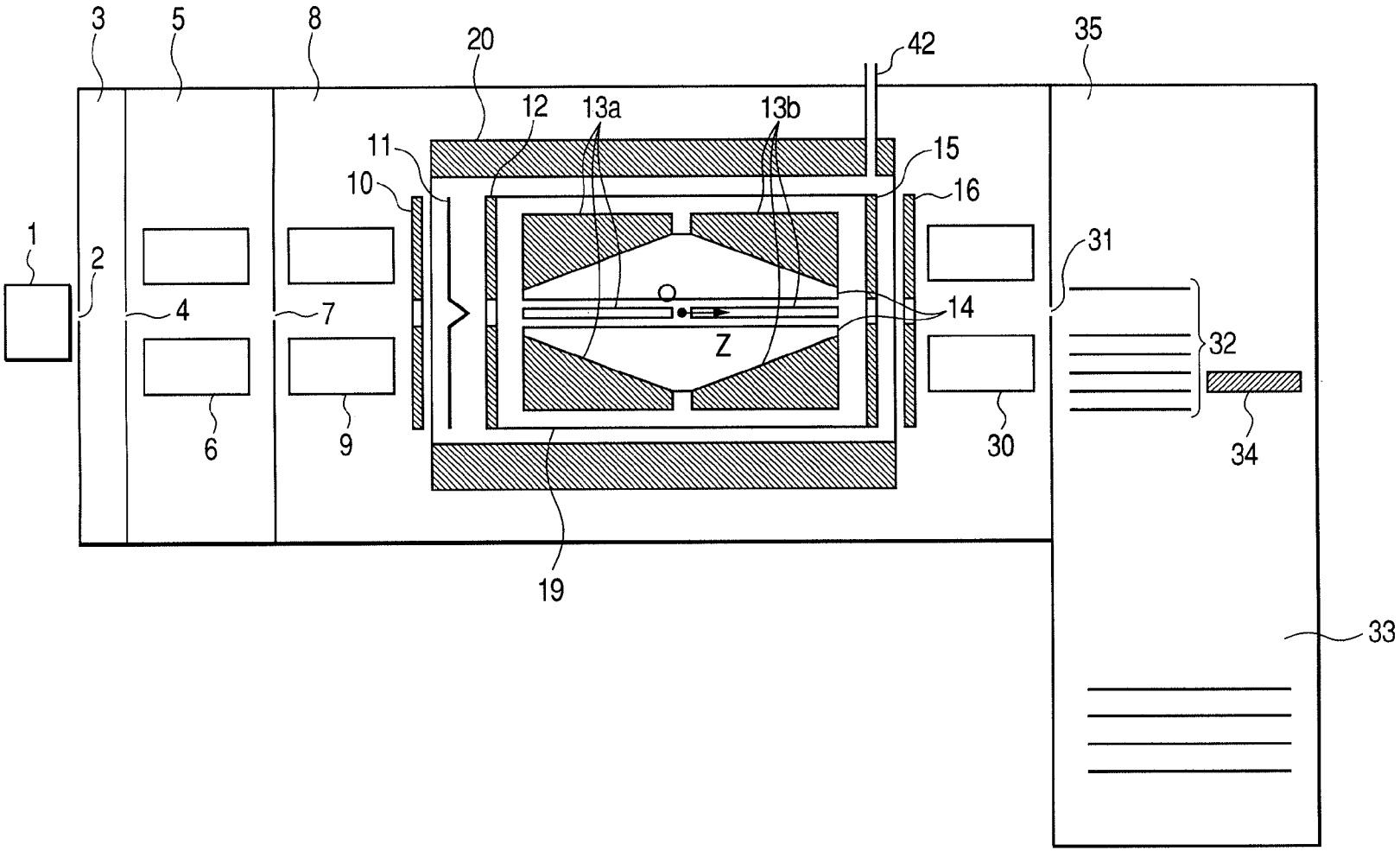
FIG. 3 is the second embodiment using a method of the present invention.
Figure 4:
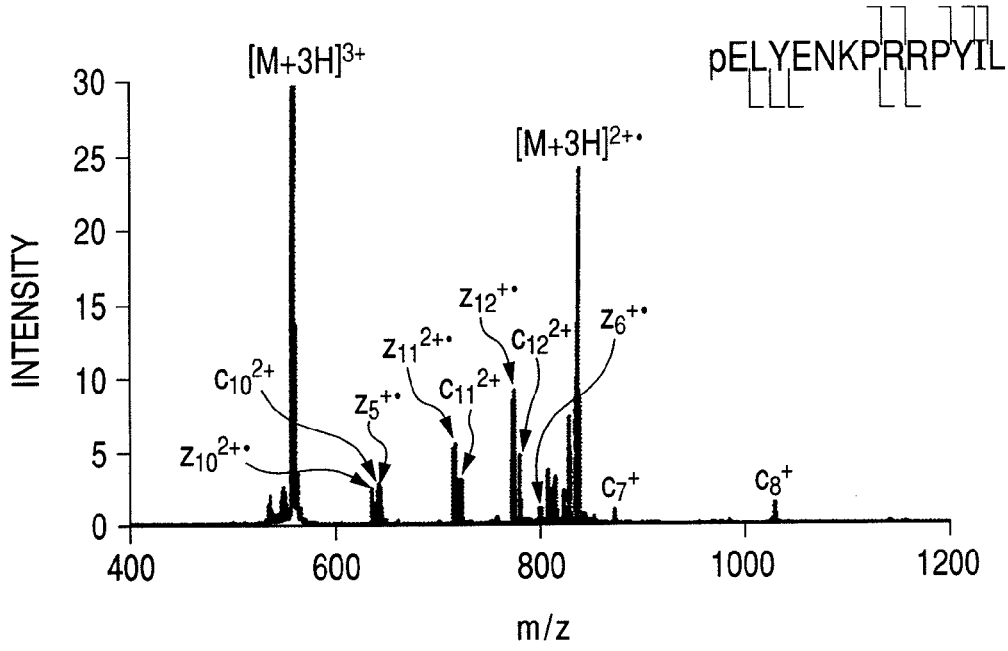
FIG. 4 is an explanatory chart illustrating an effect of a method of the present invention.
Figure 5:
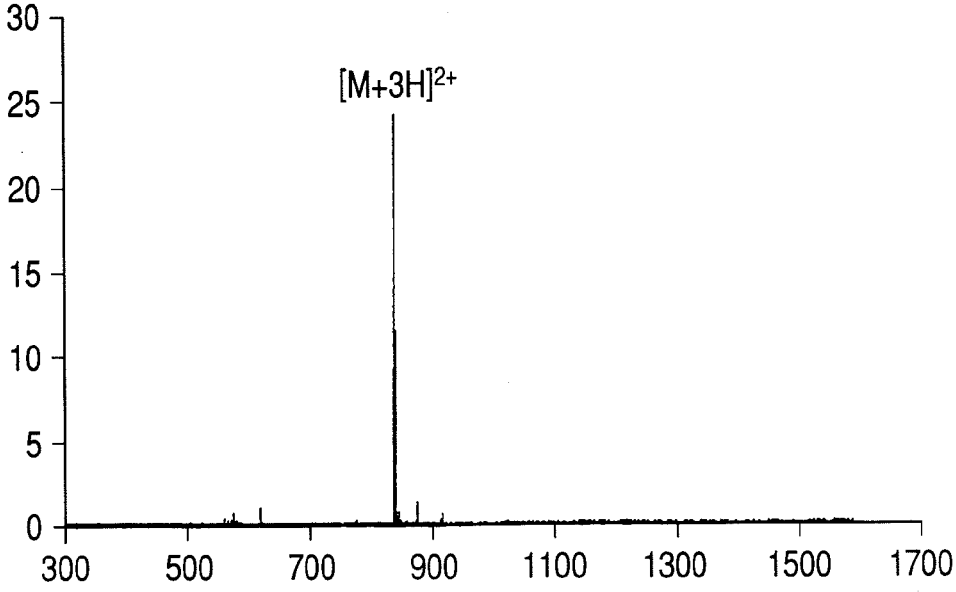
FIG. 5 is an explanatory chart illustrating an effect of a method of the present invention.
Figure 6:
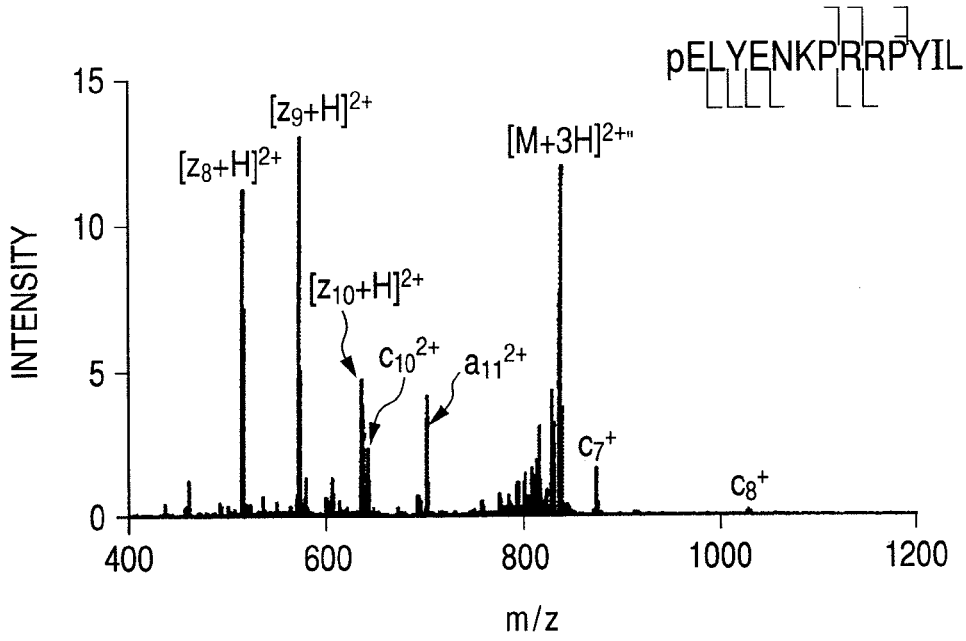
FIG. 6 is an explanatory chart illustrating an effect of a method of the present invention.

FIG. 3 shows an embodiment when TOF is used as a mass analysis section. Ions created by an ion source 1 such as an electrospray ion source and a matrix assisted laser desorption ion source, etc. pass through an orifice 2 and are introduced into the first differential pumping chamber 3. The first differential pumping chamber 3 is exhausted by using a pump and the pressure is from about 100 to 1000 Pa. Ions introduced into the first differential pumping chamber 3 pass through the orifice 4 and are introduced into the second differential pumping chamber 5. The second differential pumping chamber 5 is exhausted by using a pump and the pressure is from about 0.1 to 3 Pa. Moreover, an ion guide 6 which applies an RF voltage to a plurality of rod electrodes is generally installed in the second differential pumping chamber 5, and ions are converged by using this guide, so that they can pass through the orifice 7 efficiently. An electrode where cylindrical electrodes are placed may be used as an ion guide in addition to a plurality of rod electrodes shown in this embodiment. Ions passing through the orifice 7 are introduced into the pre-trap 9 installed in the trap chamber 8. The pre-trap 9 is able to trap a specific ion selectively by trapping the active ions in the ECD/CID trap at the back and by applying a supplemental AC voltage to a pair of rod electrodes. The trap chamber is exhausted by the pump to be at a pressure from $10^{-3}$ to $10^{-4}$ Pa. Ions selectively trapped at the pre-trap 9 are introduced into the ECD/CID trap which is similar to the one explained in the first embodiment. After operations similar to those in the first embodiment are carried out, ions are ejected. Ions ejected from the ECD/CID trap are ion-converged by an ion guide 30 which applies an RF voltage to a plurality of rod electrodes. For efficient ion convergence, gas is supplied to the ion guide section from the gas inlet tube 42 and the pressure is maintained from 0.1 to 1 Pa. Ions passing through the orifice 31 are introduced into the TOF chamber 35. The TOF chamber is exhausted by the pump and maintained at a pressure of $10^{-4}$ Pa or less. Ions accelerated in orthogonal directions by the acceleration electrode 32 are reflected by a reflectron 33 and detected by a detector 34 composed of MCP, etc. m/Z and ion intensity are determined from the flight time and the signal intensity, respectively, and the mass spectrum is obtained. A mass spectrum obtained in the second embodiment is shown. FIG. 4 shows a mass spectrum where a neurotensin +3 charged ion (pELYENKPRRPYIL, (M+3H) 3+, m/z=558.3) is ion-detected at the TOF section right after ECD is performed by the ECD/CID trap. A fragment ion caused by ECD is detected. A cleavaged sites due to ECD is shown at the upper right. By using this method, it is understood that efficient ECD can be performed. Next, FIG. 5 shows a mass spectrum obtained where a neurotensin +2 charged ion ((M+3H) 2+, m/z=837.5) is isolated and ion-detected at the TOF section for the ion after ECD. The conditions of the supplemental AC voltage for isolation can be uniquely set without the influence of the magnetic field, resulting in the control being easy. As shown in FIG. 5, other ions are ejected to outside of the trap by using a DC electric field in the axial direction and a neurotensin +2 charged ion is isolated. Next, FIG. 6 shows a mass spectrum obtained when CID is performed for the isolated ion in the trap and ion-detection is carried out at the TOF section. The cleavaged sites due to CID is shown at the upper right. The conditions of the supplemental AC voltage for CID can be uniquely set without the influence of the magnetic field, resulting in the control being easy. As shown in FIG. 6, it is possible to detect the fragment ion created by CID from the neurotensin +2 charged ion. As mentioned above, it is shown that the ECD/CID trap of the present invention can perform highly accurate ECD/CID without the influence of the magnetic field. On the other hand, in a conventional method which uses the pseudopotential in the radial direction, accurate isolation and CID are impossible because it is speculated that the influence of the mass shift from 5 to 10 Th is obtained under the conditions of this embodiment due to the influence of the magnetic field during isolation and CID.

Third Embodiment

Figure 7:
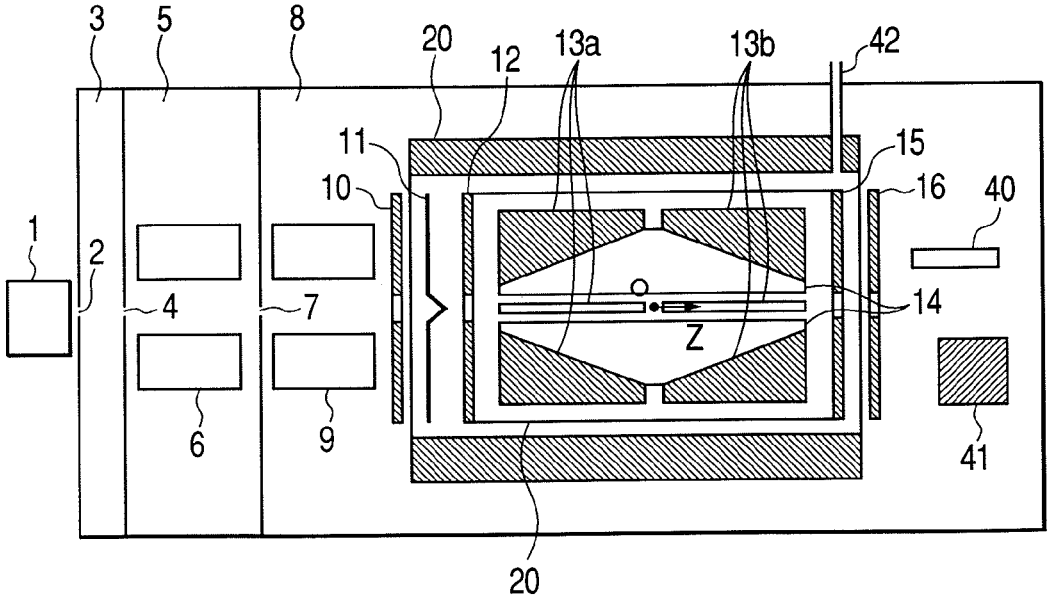
FIG. 7 is the third embodiment using a method of the present invention.

FIG. 7 is an embodiment in the case when mass separation and detection are performed in the ECD/CID trap. The operations from the ion source 1 to the ECD/CID trap are omitted because they are similar to the second embodiment. After reaction at the ECD/DIC trap, ions having a different m/Z can be ejected, in order, by scanning the supplemental AC frequency. The ejected ions are deflected by a conversion dynode 40 and detected by using a detector 41 such as an electron multiplier, etc. Since there is a relationship shown in (expression 3) between the frequency of the supplemental AC voltage and the ejected m/Z, the m/Z can be calculated and converted to a mass spectrum. In the configuration of the third embodiment, the mass selectivity is poor compared with the configuration of the second embodiment, but there is an advantage in which the device cost can be greatly reduced. Moreover, excellent mass selectivity can be obtained within a wide range of mass by scanning the DC potential and the supplemental AC frequency at the same time. According to the configuration of the present invention, an ion trap can be provided in which highly accurate isolation, ECD, and CID can be efficiently performed.

What is claimed is:

1. A mass spectrometer comprising:

an ion-trap which has a plurality of rod electrodes and generates a multipole field;

a means for generating a magnetic field in the axial direction of said ion trap;

a means for creating a DC harmonic potential in the axial direction of said ion trap; and an electron source for introducing electrons to the central axis of said ion trap.

2. A mass spectrometer according to claim 1, wherein a means for creating said DC harmonic potential is a vane lens provided between said rod electrodes.

3. A mass spectrometer according to claim 2, wherein a means for applying a voltage to said vane lens is included, and an axial DC electrostatic potential is created by applying a voltage to said vane lens.

4. A mass spectrometer according to claim 3, wherein the voltage applied to said vane lens is 5 V or more and 200 V or less relative to the off-set potential of said rod electrodes.

5. A mass spectrometer according to claim 1, wherein a means for applying a supplemental AC field in the axial direction of said ion trap is included and ions in a specific m/Z range are resonance-ejected outside the trap.

6. A mass spectrometer according to claim 5, wherein a means for applying an AC voltage between a vane lens is included and a supplemental AC field is applied in said axial direction.

7. A mass spectrometer according to claim 1, wherein a means for supplying a gas to said ion trap is included and the pressure of said gas is 0.03 Pa or more and 3 Pa or less in the case of helium and 0.01 Pa or more and 1 Pa or less in the case of argon or nitrogen.

8. A mass spectrometer according to claim 1, wherein a means for applying a supplemental AC voltage in the axial direction of said ion trap and a means for supplying gas to said ion trap are included, the kinetic energy of an ion in a specific m/Z range is activated, and there is dissociation due to collision with the gas.

9. A mass spectrometer according to claim 8, wherein a means for applying an AC voltage to a vane lens is included and a supplemental AC field is applied in said axial direction.

10. A reaction cell comprising:

an ion trap which has a plurality of rod electrodes and generates a multipole field;

a means for generating a magnetic field in the axial direction of said ion trap;

a means for creating a DC harmonic potential in the axial direction of said ion trap; and an electron source for introducing electrons to the central axis of said ion trap.

11. A reaction cell according to claim 10, wherein a means for creating said DC harmonic potential is a vane lens provided between said rod electrodes.

12. A reaction cell according to claim 11, wherein a means for applying a voltage to said vane lens is included and an axial DC electrostatic potential is created by applying a voltage to said vane lens.

13. A mass spectrometer comprising:

a means which has a plurality of rod electrodes and generates a multipole rod field;

a means for generating a magnetic field in an axial direction of said rod electrodes;

a means for creating an axial DC porential in a middle part of said rod electrode; and an electron source for introducing electrons to a central axis of said rod electrodes.

14. A mass spectrometer according to claim 13, wherein said means for creating an axial DC potential in the middle pad of said rod electrodes is a vane lens provided between said rod electrodes.

15. A mass spectrometer comprising:

a means which has a plurality of rod electrodes and generates a multipole rod field;

a means for generating a magnetic field in an axial direction of said rod electrodes;

a means for oscillating trapped ions in the axial direction within said rod electrodes; and an electron source for introducing electrons to a central axis of said rod electrodes.

16. A mass spectrometer according to claim 15, wherein said means for oscillating trapped ions in the axial direction within said rod electrodes is a supplemental AC field in the axial direction of said rod electrodes.

* * * * *

UNITED STATES PATENT AND TRADEMARK OFFICE

CERTIFICATE OF CORRECTION

PATENT NO. : 7,589,321 B2
APPLICATION NO. : 11/671562
DATED : September 15, 2009
INVENTOR(S) : Hashimoto et al.

It is certified that error appears in the above-identified patent and that said Letters Patent is hereby corrected as shown below:

Title Page; should read:

(30) Foreign Application Priority Data

Feb. 6, 2006 (JP) 2006-027860

Signed and Sealed this

First Day of December, 2009

David J. Kappos

David J. Kappos
*Director of the United States Patent and Trademark Office*